United States Patent [19]

Okamoto et al.

[11] 4,338,132

[45] Jul. 6, 1982

[54] PROCESS FOR FABRICATING FIBER-REINFORCED METAL COMPOSITE

[75] Inventors: Hideho Okamoto, Toyonaka; Ken-ichi Nishio, Ibaraki, both of Japan

[73] Assignee: Sumitomo Chemical Company, Limited, Osaka, Japan

[21] Appl. No.: 78,896

[22] Filed: Sep. 25, 1979

[30] Foreign Application Priority Data

Sep. 27, 1978 [JP] Japan ..... 53-119716

[51] Int. Cl.[3] ..... B22F 3/00

[52] U.S. Cl. ..... 75/208 R; 75/226; 75/DIG. 1

[58] Field of Search ..... 75/226, 208 R, DIG. 1

[56] References Cited

U.S. PATENT DOCUMENTS 3,443,301 5/1969 Basche et al. ..... 75/DIG. 1

3,994,722 11/1976 Kaarlela et al. ..... 75/DIG. 1

4,060,412 11/1977 Divecha ..... 75/226

4,060,413 11/1977 Mazzei et al. ..... 75/229

4,259,112 3/1981 Dolowy, Jr. et al. ..... 75/229

*Primary Examiner*—Brooks H. Hunt

*Attorney, Agent, or Firm*—Birch, Stewart, Kolasch & Birch

[57] ABSTRACT

A process for fabricating a fiber-reinforced metal composite is disclosed which comprises laminating a plurality of a sheet-like precomposites comprising bundles of filaments of metal reinforcing fibers, among the filaments of which a matrix metal powder having an average particle size of not more than ½ of the diameter of the fiber is spread, and among bundles of which a matrix metal powder having an average particle size of 2 to 10 times the diameter of the fiber is spread, and hot-pressing the resulting laminate either in a vacuum or in an atmosphere of an inert gas.

15 Claims, 1 Drawing Figure

PROCESS FOR FABRICATING FIBER-REINFORCED METAL COMPOSITE

Figure 1:
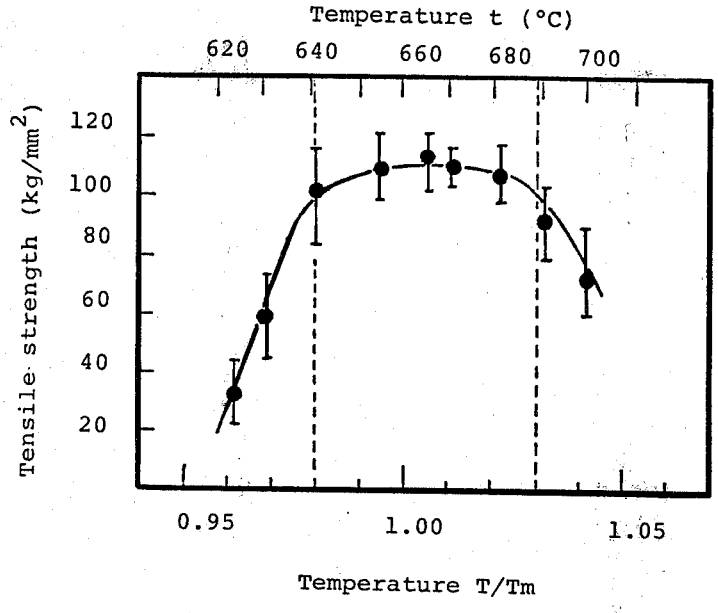

The present invention relates to a process for fabricating inorganic or metallic fiber-reinforced metal composites having excellent strength, stiffness and high temperature resistance by a powder metallurgical method.

Materials which have a high strength (or a high specific strength) and a high modulus of elasticity (or a high specific modulus of elasticity) at high or low temperatures are in great demand in a variety of fields such as aerospace, atomic energy, the automobile industry and natural gas tanks. As such materials, fiber-reinforced metal composites (hereinafter referred to as "FRM") have been recently attracting attention in place of metallic alloy materials or fiber-reinforced resin composites (hereinafter referred to as "FRP").

For production of FRM, various methods have been already proposed, typical examples of which are as follows: (1) liquid phase process such as molten metal infiltration; (2) solid phase process such as diffusion bonding; (3) powder metallurgy; (4) depositing process such as plasma spraying, electrodeposition, chemical vapor deposition, sputtering or ion plating; (5) unidirectional solidification; and (6) plastic processing such as hot rolling. The process (4) is, in many cases, adopted in combination with the process (1), (2) or (3).

For obtaining excellent FRM having high strength and modulus of elasticity, a fiber for reinforcement to be incorporated therein for reinforcement is desired to satisfy the following conditions first, as to the form of the fiber, (a) being a continuous fiber and (b) having a small diameter in general for improvement of fiber strength, and second as to the quality of the surface of fiber, (c) showing good wetting to a matrix metal without undesirable reaction. Therefore, limitation is imposed upon the procedure for the production of FRM, as mentioned below, and techniques of relatively higher degree are necessitated in comparison with FRP and metallic alloys.

On the basis of the condition (a), first, the process (5) among the above mentioned methods for preparation of FRM is undesirable. Process (6) is not a readily practicable method for inorganic fibers which are generally susceptible to crushing or other damage because their elongation at the breaking point is small.

Explanation is next provided on the limitation in the production procedure concerning the condition (b). In the case of polycrystalline inorganic fibers or metallic fibers which are known as reinforcing fibers, the fiber strength is increased with reduction of the fiber diameter, and thus a small fiber diameter of about 10 microns is frequently adopted. In fiber reinforced materials, the external load is transmitted from the matrix to the fibers through shear stress at the fiber-matrix interface so that the presence of the matrix metal at the fiber interface without voids is necessitated. In the process (2), it is considerably difficult to spread matrix metal foil into bundles of thin fibers without leaving any voids. The so-called coating treatment according to the process (4) can overcome the stated drawback, but, in the case of the fiber diameter being small, techniques of high degree are required as manual well as labor and high cost for coating individual fibers with the metal or ceramics uniformly formly and thinly, which is disadvantageous for industrial production.

Finally, there is a problem with respect to the interface between the fiber and the matrix according to the condition (c). In general, good wetting is shown between two kinds of metals, but their reactivity is generally so large that a brittle intermetallic compound is readily formed. On the other hand, wetting between ceramics and metals is not good. In some systems such as in a glass fiber reinforced aluminum matrix, a reaction occurs under a high temperature to lower the fiber strength. It is thus desirable for preventing such reaction to keep the temperature for preparation of FRM at a level as low as possible. In this respect, the liquid phase process (1) is disadvantageous in comparison with the processes (2) and (3). In the process (1), in addition, fixation and arrangement of the fiber is difficult, and distribution of the fiber becomes non-uniform when the fiber volume fraction is low, which causes reduction of the reliability of the obtained product. Further, this process is not suitable for producing FRM products of a large size and/or of a complicated form.

The powder metallurgy process (3) has been proposed for the purpose of overcoming the above mentioned drawbacks in the production processes for FRM. In Japanese Patent Publication No. 25083/1974, for example, there is disclosed a method comprising coating the external surface of an aggregate of carbon fiber with metal powder or foil and melting the metal at a high temperature while directly passing an electric current in a vacuum to obtain a composite material composed of carbon fiber and the metal. In this method, the wetting between carbon and the molten metal is small, so that the uniform dispersion of the matrix metal in the aggregate of carbon fibers can not be attained, and voids are readily formed at the fiber-matrix interface. Japanese Patent Publication No. 37803/1976 discloses a method comprising coating carbon fiber with an organic metal compound, treating the coated product with a mixture of aluminum powder and a synthetic acrylic resin solution and then hot-pressing the product at a temperature not higher than the melting point of the matrix metal to obtain a carbon fiber-aluminum composite material. However, this method is also disadvantageous in the following respects: (i) manual labor and considerable expense are required in coating with an organic metal compound such as triethylaluminum whose industrial handling is not easy; (ii) the temperature at the hot-pressing is considerably lower than the melting point of the matrix metal (powder sintering method), so that sintering of the matrix metal powder does not proceed to such an extent as being able to be sufficiently dispersed among fibers having a small diameter, and thus formation of voids takes place readily; (iii) the hot-pressing is effected at the time when the plastic fluidity of the matrix metal is small, so that the fiber is damaged so as to become defective and reduction of fiber strength results.

There is also proposed a method in which the carbon fiber is impregnated with a slurry comprising a powder of copper or copper alloy and an adhesive binder and the thus impregnated fiber is subjected to sintering under hot-pressing or to melting and solidification (Japanese Patent Publication No. 5213/1976). In this process, too, preparation of FRM having high quality can be attained only with difficulty for the above mentioned reason (ii) in case of effecting the sintering under hot-pressing. In case of the melt infiltration, a fabricating temperature considerably higher than the melting point of the matrix metal is necessitated so as to melt and fluidify the matrix metal, so that there is the same disadvantage as seen in the above mentioned liquid phase process (1) for preparation of FRM.

As the result of extensive study for overcoming these drawbacks, it has now been found that preparation of excellent FRM without voids at the interface between the fiber and the matrix metal can be attained, even without surface treatment of the fiber, by a method comprising laminating a plurality of sheet-like precomposites in which matrix metal powders with different particle sizes are spread among filaments of fibers and among bundles of filaments at two steps, heating and laminate in a vacuum or in the atmosphere of an inert gas and hot-pressing the laminate at a temperature around the melting point of the metal.

According to the present invention, there is provided a process for fabricating a fiber-reinforced metal composite, which comprises laminating a plurality of sheet-like precomposites comprising a metal reinforcing fiber, among the filaments of which a matrix metal powder having an average particle size of not more than $\frac{1}{2}$ of the diameter of the fiber is spread, and among bundles of which a matrix metal powder having an average particle size of 2 to 10 times the diameter of the fiber is spread, and hot-pressing the resulting laminate either in a vacuum or in an atmosphere of an inert gas.

The particle size of the matrix metal powder to be spread among filaments of fiber and that of the particles to be spread among the bundles of fiber are required to be different from each other, especially in the case of reinforcing fibers having a small diameter. The reason for this requirement is explained in the following description. With respect to the uniform dispersion of the matrix particles among the filaments in fiber bundles, a high rate of filling of the matrix metal among the filaments of fiber can be obtained when the matrix metal powder to be used has an average particle size being half or less of the fiber diameter. Therefore, in the composite material produced by hot-pressing after this operation of dispersion, formation of voids can be minimized. When the average particle size of the matrix metal powder is larger than the half of the filament diameter, uniform dispersion of the matrix metal particles among filaments of fiber is very difficult, because the fiber volume fraction is required to be increased as much as possible for improving the strength of the composite material. Thus, formation of voids takes place to cause reduction of the mechanical properties such as strength and fatigue strength of the composite material.

For dispersion among bundles of fiber, matrix powder having an average particle size twice or more as large as the fiber diameter can afford a larger binding strength of fiber bundles than metal powder having a smaller particle size. The reason for this effect is speculated to be as follows. Since a metal oxide layer is generally present on the surface of metal powder, powders having a smaller particle size show relatively a larger ratio of metal oxide to metal. Therefore, when powder having a larger particle size is used, relatively a smaller amount of metal oxide is contained among the fiber bundles, and thus the binding strength of the fiber bundles is increased. Furthermore, when powder having a small particle size is among the fiber bundles it is difficult to obtain a uniform pressure at each portion even when the pressure is given at a temperature around the melting point, and thus the solid oxide layer surrounding the metal becomes difficult to tear, which may result in insufficiency of the sintering of powder resetting in the consequent formation of voids.

When the average particle size of the matrix metal to be spread among the bundles of fiber is 10 times or more as large as the fiber diameter, the surface of the sheet-like precomposite comprising groups of fiber bundles becomes markedly uneven. Therefore, it is difficult to impart a uniform pressure at a temperature around the melting point in each of all the regions of the laminated sheet-like precomposite, and formation of voids and disorder of fiber arrangement results.

The present invention will be explained further in detail in the following description.

The matrix metal powder to be used in the invention may be powder of simple metal (e.g. lead, tin, zinc, magnesium, aluminum, copper, nickel, iron, titanium) having a purity of 99.0% or more, mixtures of two or more kinds of these metal powders in a suitable ratio to obtain a composition of a solid solution or eutectic alloy or powders of alloys of two or more kinds of metals. It is desirable to select a matrix metal suitable for the use of the FRM to be obtained. For example, for the use in which a light and strong composite material is required, magnesium, aluminum or their alloys are employed. When high temperature resistance is required, copper, nickel, titanium or their alloys are employed as the matrix.

For the purpose of improving mechanical properties of the matrix metal such as the strength and the elongation, promoting the wetting between the fiber and the matrix metal and preventing undesirable reactions, mixtures of two or more kinds of metals or alloys are employed. For example, an aluminum-magnesium-copper-manganese alloy which is a highly strong aluminum alloy called duralumin is advantageously used as the matrix metal of the invention. The use of silicon-containing aluminum alloy as the matrix facilitates the production of FRM. Addition of a small amount of chromium, titanium, zirconium, lithium or magnesium to the matrix is effective, for example, for improvement of the wetting between alumina fiber and aluminum matrix.

When a mixture of different kinds of metals in powder form is used, the average particle size is desired to be close to the particle size of the main matrix metal powder. The amount to be added should be within the range whereby the composite material is not made brittle due to the formation of intermetallic compounds.

As the reinforcing fiber, there may be employed, for instance, ceramic fibers such as alumina fiber, silica fiber, alumina-silica fiber, carbon fiber, graphite fiber, silicon carbide fiber, zirconia fiber and boron fiber and ceramic whiskers, and metallic fibers such as tungsten fiber and stainless steel fiber and iron whisker. Among them, the use of ceramic fibers, especially alumina fiber, alumina silica fiber and silicon carbide fiber, is preferable, because they hardly react with various kinds of matrix metals.

The surface of such reinforcing fibers may be coated with a metal or ceramic (e.g. boron/silicon carbide) by a suitable method such as (1) the metal spraying (plasma spray), (2) the electrodeposition (electroplating, chemical plating) or (3) the vacuum evaporation (vacuum plating, chemical vapor deposition, sputtering, ion plating).

The reinforcing fiber may be in the form of bundles comprising plurality of filaments. As to the diameter of each filament, there is no particular limitation, but a diameter of 1 to 500 $\mu$m is preferable. When the diameter is smaller than 1 μm, it is difficult to obtain a matrix metal powder having a particle size smaller than the fiber diameter. When the diameter is larger than 500 μm, the strength and the flexibility of the fiber become greatly reduced. The number of filaments present in a bundle is desired to be 10 to 200,000, preferably 50 to 30,000. As to the fiber length, continuous fibers or long fibers having a length of 50 mm or more are desirable. Considering the theory of the composite material, a short fiber with an aspect ratio (ratio of fiber length to fiber diameter) of 10 or more, preferably 50 or more or a whisker may be also utilized.

It is important for obtaining a good result to select an adequate combination of the fiber and the matrix metal powder. A combination in which a reaction proceeds rapidly at the interface between the fiber and the matrix, for instance, a combination of E glass fiber and aluminum or aluminum alloy, should be avoided. In such a combination, however, the undesirable reaction at the interface between the fiber and the matrix metal can be prevented by coating the surface of the fiber with a metal or ceramic as mentioned above. A combination in which the mechanical properties of the fiber itself (e.g. strength, modulus of elasticity) at high temperature is greatly deteriorated at a temperature around the melting point of the matrix metal is also undesirable. Examples of combinations being desirable from this point of view are alumina fiber-aluminum, alumina-silica fiber-aluminum, boron fiber coated with silicon carbide-aluminum, and the like.

The preparation of a sheet-like precomposite in which the matrix metal powder is uniformly spread among the filaments and among the bundles may be effected, for instance, by the following procedure: (A) In the first step, the matrix metal powder having an average particle size half or less as large as the fiber diameter is suspended in an organic solvent, and into the resultant suspension, each fiber bundle is immersed. The concentration of the metal powder in the suspension is not particularly limited, but, in usual, an adequate dispersed state is obtained at a concentration of 10 to 30 wt%. Then, the fiber bundles impregnated with metal particles are dried. As the said organic solvent, any kind of solvents may be employed, but the one having a lower boiling point is desirable. Examples of such solvents are ketones such as acetone and methyl ethyl ketone, alcohols such as methyl alcohol and aliphatic hydrocarbon such as hexane. (B) In the second step, the thus treated fiber bundles are arranged in one direction uniformly so as to form a flat layer. On the other hand, a resin solution in an organic solvent (e.g. ketones such as methyl ethyl ketone, aromatic hydrocarbon such as toluene) is prepared, and a matrix metal powder having an average particle size 2 to 10 times as large as the fiber diameter is suspended therein. Into the thus prepared suspension, the above obtained layer of the fiber bundles is immersed, or alternatively, the suspension is applied on the layer. As the said resin, there may be employed anyone which can be completely decomposed at a temperature not higher than the vicinity of the melting point of the matrix metal is a vacuum or in the atmosphere of an inert gas, such as argon. Examples of such resins are synthetic acrylic resin and synthetic polystyrene resin. The thus treated layer of fiber bundles is dried to remove the solvent so as to obtain a sheet-like product which is a precomposite of the composite material of the invention.

Alternatively, the sheet-like precomposite can be also prepared by the following procedure. In the first step, each fiber bundle is arranged in a flat layer, and the matrix metal particles having an average particle size half or less as large as the fiber diameter are plasma-sprayed thereon. For preventing oxidation of the metal, the atmosphere at the metal-spraying is desirable to be a mixture of an inert gas (e.g. argon) and hydrogen. Then, in the second step, the further bundles are arranged in one direction to form a flat layer, and the matrix metal powder having an average particle size 2 to 10 times as large as the fiber diameter is sprayed thereon to obtain a sheet-like precomposite. The metal-spraying time is dependent upon the fiber volume fraction of the objective composite material and the conditions for hot-pressing as mentioned below. When the number of filaments in the fiber bundle is large and impregnation with the matrix metal is insufficient under metal-spraying on one side of the layer of fiber bundles, the other side of the layer may be subjected to the treatment of metal-spraying, also.

The techniques of the said plasma-spraying or metal-spraying are well known to persons skilled in this field of arts and are described, for example, in "Metal Spraying and the Flame Deposition of Ceramics and Plastics" (1963), Griffin, London (W. W. Ballard) and "Flame Spray Handbook", Vol. 3 (1965), Metco, New York (H. S. Ingham and A. P. Shepard).

The thus obtained sheet-like precomposite is cut into pieces according to the shape of the objective composite material, and a plurality of them are laminated. Then, the laminate is subjected to heating in a vacuum or in the atmosphere of an inert gas and to hot-pressing at a temperature around the melting point of the matrix metal to obtain FRM in which the matrix metal is spread among filaments in a satisfying state.

For the procedure for lamination of the sheet-like precomposite, unidirectional arrangement or polyaxial arrangement may be adopted depending on the use of the objective composite material. In this step, the laminate may be shaped, for instance, in the form of a curved plate or cylinder, in addition to a flat plate, according to the form of the objective product.

Heating may be effected by a batch treatment by the aid of a hot press using a mold or HIP (Hot Isostatic Pressing). By a continuous treatment by hot rolling at a temperature around the melting point of the matrix metal, too, preparation of the objective FRM is possible, without damaging fibers, by reducing gradually the draft by the aid of a multistage roll.

The vicinity of the melting point of the matrix metal is intended to mean a range from 0.98 $T_m$ to 1.03 $T_m$, $T_m$ being the melting point of the matrix metal in term of absolute temperature. When the temperature at hot-pressing is lower than 0.98 $T_m$, the plastic fluidity of the matrix metal becomes smaller, so that the oxide layer of the metal powder surface can not be torn, which results in insufficiency of sintering and in formation of a considerable number of voids. Therefore, the adhesion at the interface between the fiber and the matrix metal in the obtained FRM becomes insufficient, and the mechanical properties such as strength, modulus of elasticity and fatigue strength are inferior. On the other hand, when the temperature at hot-pressing is higher than 1.03 $T_m$, the flow of the molten matrix metal becomes large to disorder the arrangement of the reinforcing fibers, and only the matrix metal flows out in a too large amount from the composite material during hot-pressing, so that partial increase of the fiber volume fraction takes place. It is confirmed both theoretically and experimentally that, in unidirectionally reinforced FRM, the strength is rapidly reduced when the fiber arrangement is disordered and an angle of 3° to 5° or more is made to the direction of tension. In the said case wherein the temperature at hot-pressing is high, too, the mechanical strength is lowered.

The condition for hot-pressing is varied depending on the fiber volume fraction of the objective composite material. In usual, a pressure of 25 to 250 kg/cm$^2$ can afford FRM with good infiltration of fibers with the matrix without damaging the fiber.

According to the process of the present invention, complete infiltration of reinforcing fibers with the matrix, which has been difficult in conventional procedures for preparation of FRM by the so-called powder metallurgy process, can be attained advantageously, without damaging the fiber, even when the fiber diameter is small and the fiber volume fraction is high and even when the fiber is not subjected to a surface treatment.

The process of the invention is suitable for obtaining a sheet-like or thin product in the form of flat plate, curved plate or the like. The obtained products possess, even at higher or lower temperatures at which the matrix metal loses its mechanical properties, such excellent properties (strength, modulus of elasticity, fatigue strength) as seen at room temperature. Therefore, the composite material obtained according to the invention is considered to be an extremely excellent material, in comparison with metal alloy materials being low in high temperature strength and fatigue strength or being fragile at low temperatures (e.g. in case of steel) or with FRP materials lacking in high temperature resistance, and is thus useful in various fields such as aerospace, atomic energy, the automobile industry and gas tanks.

The present invention will be explained further in detail by the following Examples which are not intended to limit the scope of the invention.

EXAMPLE 1

Bundles of continuous alumina fibers (alumina, 85% by weight; silica, 15% by weight) having a fiber diameter of 15 microns and a number of filaments of 200 in a bundle and showing a tensile strength of 22.3 t/cm$^2$ (determined at gauge length, 20 mm) and modulus of elasticity of 2350 t/cm$^2$ are wound around a mandrel in parallel with the same pitch in one layer. The mandrel is then immersed into an aluminum powder suspension obtained by dispersing Alpaste 0225M (manufactured by Toyo Aluminium K.K.; average particle size, 5 microns: cumulative frequency distribution, 5 microns=50%) (60 g) in acetone (500 ml) (hereinafter referred to as "first step suspension") and then dried at room temperature. The mandrel is then immersed into a suspension obtained by dispersing aluminum powder having an average particle size of 44 microns (purity, 99.5%) (60 g) and polymethyl methacrylate (40 g) in methyl ethyl ketone (400 ml) (hereinafter referred to as "second step suspension"). After drying in the air, the sheet-like precomposite formed on the mandrel is cut open to obtain a sheet, which is cut into pieces according to the size of the mold of the hot press. A designed number of the pieces are laminated in one direction, and the laminate is placed into the mold of the hot press. The laminate is heated at 500° C. for 30 minutes in vacuo to eliminate the solvent and to decompose the polymer. Then, the temperature is elevated to 665° C. in vacuo or in the atmosphere of an inert gas, and a pressure of 50 kg/cm$^2$ is given to the specimen in the mold of the press for 1 to 2 hours so as to combine the sheets and to impregnate the fiber with the matrix. The tensile strength and the bending strength of the thus obtained FRM (average on 10 specimens) are shown in Table 1. The modulus of elasticity of the FRM is $1.45\times10^4$ kg/mm$^2$.

For comparison, other composite materials are prepared by the same procedure as above but using only the first step suspension or the second step suspension for immersion. The strength of the thus obtained materials for comparison is also shown in Table 1. A close correlation is confirmed between the hot press temperature and the strength of the obtained composite material. The relationship between the temperature at pressurizing and the tensile strength is shown in FIG. 1 of the accompanying drawing wherein $T_m$ indicates the melting point of aluminum in terms of absolute temperature (the fiber volume content of each composite material being 50±2%).

TABLE 1

| Suspension for immersion | Strength of composite material (kg/mm$^2$) | |
|---|---|---|
| | Tensile strength | Bending strength |
| First step suspension alone | 64 | 83 |
| Second step suspension alone | 58 | 75 |
| First step and second step suspensions | 113 | 147 |

Note:
Fiber volume content of composition material = 50 ± 2%

EXAMPLE 2

The same continuous alumina fiber as in Example 1 is wound around a mandrel in parallel with the same pitch in one layer. To the mandrel, a suspension obtained by dispersing aluminum-silicon alloy powder having an average particle size of 5 microns (usually called silumin, comprising aluminum incorporated with 12% by weight of silicon) (40 g) (purity, 99.0%) in acetone (500 ml) is applied by spraying. After drying at room temperature, a suspension obtained by dispersing aluminum-silicon alloy powder having an average particle size of 44 microns (60 g) and polymethyl methacrylic acid ester (40 g) in methyl ethyl ketone (400 ml) is further applied thereto by spraying and then dried in the air. The sheet-like precomposite with a thickness of 0.5 mm is cut into pieces according to the size of the press mold. Twenty of these pieces are laminated in one direction and charged into the hot press, which is heated at 500° C. for 30 minutes in vacuo. Then, the temperature is elevated up to 590° C. in the atmosphere of argon gas, and a pressure of 25 kg/cm$^2$ is given for 1 to 2 hours. After cooling to 300° C. or lower, the product is taken out to obtain a composite material (150×150 mm) having a thickness of 2.1 mm. The average bending strength is 152 kg/mm$^2$ (fiber volume content, 50%).

EXAMPLE 3

Bundles of alumina fiber having a fiber diameter of 19 microns and a number of filaments of 100 in each bundle and showing a tensile strength of 19.2 t/cm$^2$ (determined gauge length, 20 mm) and a modulus of elasticity of 2240 t/cm$^2$ (alumina, 85% by weight; silica, 15% by weight) are immersed into a suspension obtained by dispersing Alpaste 0225M having an average particle size of 5 microns (manufactured by Toyo Aluminium K.K.) (150 g) and electrolytic copper powder having an average particle size of 5 microns (purity, 99.9%) in acetone (500 ml) (the proportion of aluminum to copper being 94.4:5.6 parts by weight) and then into a suspension obtained by dispersing aluminum powder having an average particle size of 44 microns (purity, 99.5%) (94.4 g), electrolytic copper powder having an average particle size of 50 microns (5 g) (purity, 99.9%) and polymethyl methacrylic acid ester (40 g) in toluene (400 ml). Then, the strands are wound around a mandrel in parallel with the same pitch in one layer, and toluene is gradually eliminated by evaporation. The thus formed sheet-like precomposite is cut open to obtain a sheet. A plurality number of sheets are laminated and subjected to hot-pressing in the atmosphere of argon gas (680° C., 100 kg/cm$^2$) to obtain FRM with good impregantion of the fiber with the matrix. The bending strength of the FRM is 144 kg/mm$^2$ (fiber volume content, 50%).

EXAMPLE 4

The surface of carbon fiber T-300 (manufactured by Toray Industries Inc.; fiber diameter, 6.9 microns; number of filaments, 3000; tensile strength, 27 t/cm$^2$; modulus of elasticity at tension, 2500 t/cm$^2$) is subjected to electrolytic plating with copper under the following conditions: electrolytic bath, copper sulfate 200 g/lit plus sulfuric acid 50 g/lit; electrolytic temperature, 20° C.; electric current density, 0.5 A/dm$^2$; electric current-passing time, 5–10 minutes. The thus treated carbon fiber whose surface is coated with a copper layer having a thickness of 0.7 micron is washed well and, after drying, wound around a mandrel in parallel with the same pitch in one layer. Electrolytic copper powder having an average particle size of 40 microns (purity, 99.9%) is screened by a water sieve to collect particles having a diameter of 5 microns or less. By determination of their particle size distribution, the cumulative frequency distribution is proved to be as follows: 3 microns=50%. Thus collected copper powder having an average particle size of 3 microns (150 g) is dispersed in methyl ethyl ketone (500 ml), and into the resultant suspension, the carbon fiber wound around the mandrel is immersed and then dried in the air. The fiber is further immersed into a suspension obtained by dispersing copper powder having an average particle size of 44 microns (180 g) and polystyrene having an average molecular weight of 50,000 (40 g) in toluene (400 ml) and then dried to form a sheet-like precomposite on the mandrel. The precomposite is cut open to obtain a sheet, which is cut into pieces according to the size of the press mold. Twenty five of these pieces are laminated in one direction. The laminate is heated at 700° C. for 1 hour in the atmosphere of argon gas. Then, the temperature is elevated up to 1060° C., and after 30 minutes, a pressure of 25 kg/cm$^2$ is given for 10 minutes. After cooling, FRM being 50×50 mm is size and having a thickness of 4 mm is obtained. The tensile strength of this FRM is 108 kg/mm$^2$ (fiber volume content, 50%).

EXAMPLE 5

As in Example 1, a continuous alumina fiber is wound around a mandrel in one layer, and to the surface of the alumina fiber on the rotating mandrel, aluminum powder with purity of 99.9% having an average particle size of 5 microns (manufactured by High Purity Chemical Research Laboratory) is sprayed by a plasma spraying apparatus (5MR-630 manufactured by Metco; equipped with power-supplying apparatus). The condition for the spraying is as follows: atmosphere, mixture of argon and hydrogen (flowing rate, 30:1); distance of spraying, 22 cm; time of spraying, 70 seconds. Then, the sheet is taken out from the mandrel, and its other side is subjected to the same spraying for 25 seconds. On this surface, aluminum powder with purity of 99.9% having an average particle size of 44 microns is further sprayed for 20 seconds under the same conditions as above to obtain a sheet-like precomposite having an average thickness of 0.35 mm, which is cut into pieces of 66×10 mm in size. Thirty two of these pieces are laminated, each fiber axis being arranged in one direction, and the laminate is kept at 670° C. for 30 minutes under a pressure of 50 kg/cm$^2$ in the atmosphere of argon gas and then cooled to obtain an alumina fiber-reinforced aluminum composite material having a thickness of 2.2 mm. The bending strength of thus obtained composite material is 138 kg/cm$^2$. The fiber volume content determined by dissolving the matrix with hydrochloric acid is 52%. By observation of the broken surface at bending by use of an electron microscope, pulling-out of fiber is not seen at all, and infiltration of fibers with the matrix metal is complete, the void content being 0.1% by volume or less. It is thus confirmed that the alumina fiber reinforces aluminum sufficiently.

For comparison, the sheet-like precomposite obtained after the spraying of aluminum powder having an average particle size of 5 microns in the first step in the above procedure is subjected to heating and hot-pressing under the same condition to prepare a composite material. The bending strength of this material is only 81 kg/mm$^2$. By observation of the broken surface at bending, presence of voids in an amount of about 3% by volume is confirmed at the inerface between the fiber and the matrix.

The invention being thus described, it will be obvious that the same way may be varied in many ways. Such variations are not to be regarded as a departure from the spirit and scope of the present invention, and all such modifications as would be obvious to one skilled in the art are intended to be included within the scope of the following claims.

We claim:

1. A process for fabricating a fiber-reinforced metal composite, which comprises laminating a plurality of sheet-like precomposites comprising bundles of filaments of metal reinforcing fibers, among the filaments of which a matrix metal powder having an average particle size of not more than ½ of the diameter of the fiber is spread, and among the bundles of which a matrix metal powder having an average particle size of 2 to 10 times the diameter of the fiber is spread, and hot-pressing the resulting laminate either in a vacuum or in an atmosphere of an inert gas.

2. A process according to claim 1, wherein the precomposite is produced by first preparing bundles of filaments of the reinforcing fibers and spreading the matrix metal powder among the filaments of the metal-reinforcing fiber bundles, the matrix metal powder having an average particle size of not more than ½ of the diameter of the metal-reinforcing fiber, and second spreading the matrix metal powder among the bundles of the fiber so as to fabricate said sheet-like precomposite, the matrix metal powder having an average particle size of 2 to 10 times the diameter of the fiber.

3. A process according to claim 2, wherein the first spreading step is carried out by immersing the bundles of the fibers into an organic solvent suspension of the matrix metal powder and drying the resulting fiber, or by means of a plasma spraying.

4. A process according to claim 2, wherein the second spreading step is carried out by applying an organic solvent suspension comprising a resin and the matrix metal powder to the bundles of the fibers and drying the resulting fibers, or by means of a plasma spraying.

5. A process according to claim 4, wherein the applying of the organic solvent suspension is effected by immersion.

6. A process according to claim 1, wherein the hot-pressing is carried out at the vicinity of the melting point of the matrix metal.

7. A process according to claim 1, wherein the hot-pressing is carried out at a temperature from 0.98 $T_m$ to 1.03 $T_m$, in which $T_m$ is the melting point in terms of the absolute temperature of the matrix metal.

8. A process according to claim 1, wherein the matrix metal powder is made of a metal selected from the group consisting of lead, zinc, tin, magnesium, aluminum, copper, nickel, iron, titanium and mixtures thereof.

9. A process according to claim 8, wherein the metal matrix powder comprises a mixture of said metals in solid solution or an eutectoid.

10. A process according to claim 1, wherein the metal-reinforcing fiber is a ceramic fiber or a metal fiber.

11. A process according to claim 1, wherein the diameter of the filament is 1 to 500 $\mu$m.

12. A process according to claim 1, wherein the number of filaments in each bundle is 10 to 200,000.

13. A process according to claim 1, wherein the aspect ratio of the fiber is at least 10.

14. A process according to claim 1, wherein the fiber is a continuous fiber or a fiber of 50 mm or longer in length.

15. A fiber-reinforced metal composite produced by the process of claim 1.

* * * * *